US008469245B2

(12) United States Patent
Gregory et al.

(10) Patent No.: US 8,469,245 B2
(45) **Date of Patent: *Jun. 25, 2013**

(54) ROTATABLE PLATFORM

(75) Inventors: Thomas M. Gregory, Belgrade, MT (US); Robert A. Kincaid, Bozeman, MT (US); Thomas A. Marx, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/566,065

(22) Filed: Aug. 3, 2012

(65) Prior Publication Data

US 2012/0298705 A1 Nov. 29, 2012

Related U.S. Application Data

(63) Continuation of application No. 12/734,012, filed as application No. PCT/US2008/011603 on Oct. 9, 2008, now Pat. No. 8,251,266.

(60) Provisional application No. 60/998,110, filed on Oct. 9, 2007.

(51) Int. Cl.
*F41C 33/02* (2006.01)

(52) U.S. Cl.
USPC ..... 224/198

(58) Field of Classification Search
USPC ..... 224/197, 198, 199, 200, 282; 248/221.11; 403/93, 97
See application file for complete search history.

(56) References Cited

U.S. PATENT DOCUMENTS

| | | | | | |
|---|---|---|---|---|---|
| 4,577,986 | A * | 3/1986 | Wang | 403/93 |
| 5,058,239 | A * | 10/1991 | Lee | 16/324 |
| 5,564,610 | A * | 10/1996 | Barron | 224/268 |
| 5,641,102 | A * | 6/1997 | Hellweg | 224/198 |
| 6,161,741 | A * | 12/2000 | French | 224/198 |
| 6,189,751 | B1 * | 2/2001 | Tserng | 224/244 |
| 6,330,733 | B1 * | 12/2001 | Rauschenberger | 16/326 |
| 6,688,797 | B2 * | 2/2004 | Park et al. | 403/93 |
| 7,140,072 | B2 * | 11/2006 | Leng | 16/326 |
| 8,100,304 | B2 * | 1/2012 | Tanzini | 224/200 |
| 2007/0023468 | A1 * | 2/2007 | Ford | 224/197 |
| 2011/0121043 | A1 * | 5/2011 | Kincaid et al. | 224/191 |

* cited by examiner

*Primary Examiner* — Justin Larson
(74) *Attorney, Agent, or Firm* — Wooten & Shaddock, PLC

(57) ABSTRACT

A platform with a platform body having a plate attachment portion. The plate attachment portion includes a platform opening and the platform opening includes a projection that extends into a portion of the platform opening. A platform plate portion is coupled to an accessory plate portion, through the platform opening, such that the platform plate portion and the accessory plate portion are rotatable relative to the platform body. A portion of the platform plate portion is rotatably slidable along a surface of the internal projection, and a portion of the accessory plate portion is rotatably slidable along a surface of the internal projection. A release lever is pivotably attached to the platform body and the release lever is pivotable between a locking position and an unlocking position. The release lever is capable of releasably interacting with a primary notch of the platform plate portion.

20 Claims, 10 Drawing Sheets

ROTATABLE PLATFORM

CROSS-REFERENCE TO RELATED APPLICATIONS

This is a continuation of U.S. patent application Ser. No. 12/734,012, filed Jun. 25, 2010 and issued as U.S. Pat. No. 8,251,266, which is a 371 national phase application of PCT/US200811603, filed Oct. 9, 2008, which claims benefit of U.S. Patent Application Ser. No. 60/998,110, filed Oct. 9, 2007, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present invention is directed generally to a rigid or semi-rigid platform for attaching a handgun holster or other accessory carrier to a belt, a waistband of a pair of trousers, another article of clothing, to a MOLLE or S.T.R.I.K.E. webbing attachment, or to a harness or one or more pieces of webbing or strap material. More specifically, the present invention is directed to a platform that allows an attached holster or other accessory carrier to be selectively rotated between at least two positions relative to the platform body.

2. Description of Related Art

Many handgun users, particularly military and law enforcement personnel, carry a handgun in a holster designed to protect the handgun and hold it securely. Holsters can be worn in a number of ways and in a variety of locations on a user's body, such as on the chest, under an arm, at the waist, on the thigh, or around an ankle.

Unfortunately, most modern holsters and holster carriers can be uncomfortable to wear, particularly by someone who must wear the holster while in a seated position. For example, when a law enforcement officer sits in a vehicle, the holster, which is typically attached to the officer's belt in the officer's hip region, generally contacts the seat and is forced upward by the seat. This typically causes the officer's belt to be pushed up and/or the rear of the handgun to be pushed into the officer's side, resulting in great discomfort to the officer.

SUMMARY OF THE INVENTION

The prior holster holders and carriers fail to provide a user with the ability to readily and easily rotate or re-position a holster or other attached accessory carrier from a normal, carry position to a rotated or angular position. Furthermore, the prior holster holders fail to provide a holster holder or carrier that provides a user with the ability to readily and easily rotate a holster or other attached accessory carrier from a rotated or angular position to a normal, carry position.

Accordingly, the present invention is directed generally to a rigid or semi-rigid holder, carrier, or platform usable for attaching a handgun holster or other to accessory carrier to a belt, a waistband of a pair of pair of trousers, another article of clothing, to a MOLLE or S.T.R.I.K.E. webbing attachment, or to a harness or one or more pieces of webbing or strap material. More specifically, the platform includes several adjustment points that allow a relative rotational angle between the platform and an attached holster or other accessory carrier to be changed.

In various exemplary embodiments, the platform comprises a platform body, a platform plate, and an accessory plate.

Thus, in certain exemplary embodiments, a holster or other accessory carrier may be attached or coupled to the accessory plate such that the platform plate and the accessory plate may be turned or rotated with respect to the platform body to allow a user to be more comfortable while in, for example, a seated position, while still having access to a holstered handgun or a carried accessory. Then, when the user returns to a standing position, the holster or other accessory carrier can easily be returned to a normal, carry position.

In certain exemplary embodiments, a holster or other accessory carrier may be maintained in a movable position allowing for movement of the holster or carrier as the a user moves, thereby allowing for a constant repositioning and allowance for, for example, seat position, movement of the wearer, or interfering objects.

In various exemplary, non-limiting embodiments of this invention, a holster or other accessory carrier may be adjustably rotated or turned to one of a number of predetermined angles. That is to say, an angle between the platform and a holster, for example, may be adjusted between several determined adjustment points.

Thus, the present invention comprises a new and improved platform that allows an attached holster or other accessory carrier to be rotated to one or more determined angles relative to the platform.

Accordingly, this invention provides a platform, having a simple and reliable holster or accessory carrier attachment system.

This invention separately provides a platform that allows a holster or other accessory carrier to be selectively rotated between at least a normal, carry position, and a rotated position.

This invention separately provides a platform, which is capable of being manufactured using injection molding and/or thermoform production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
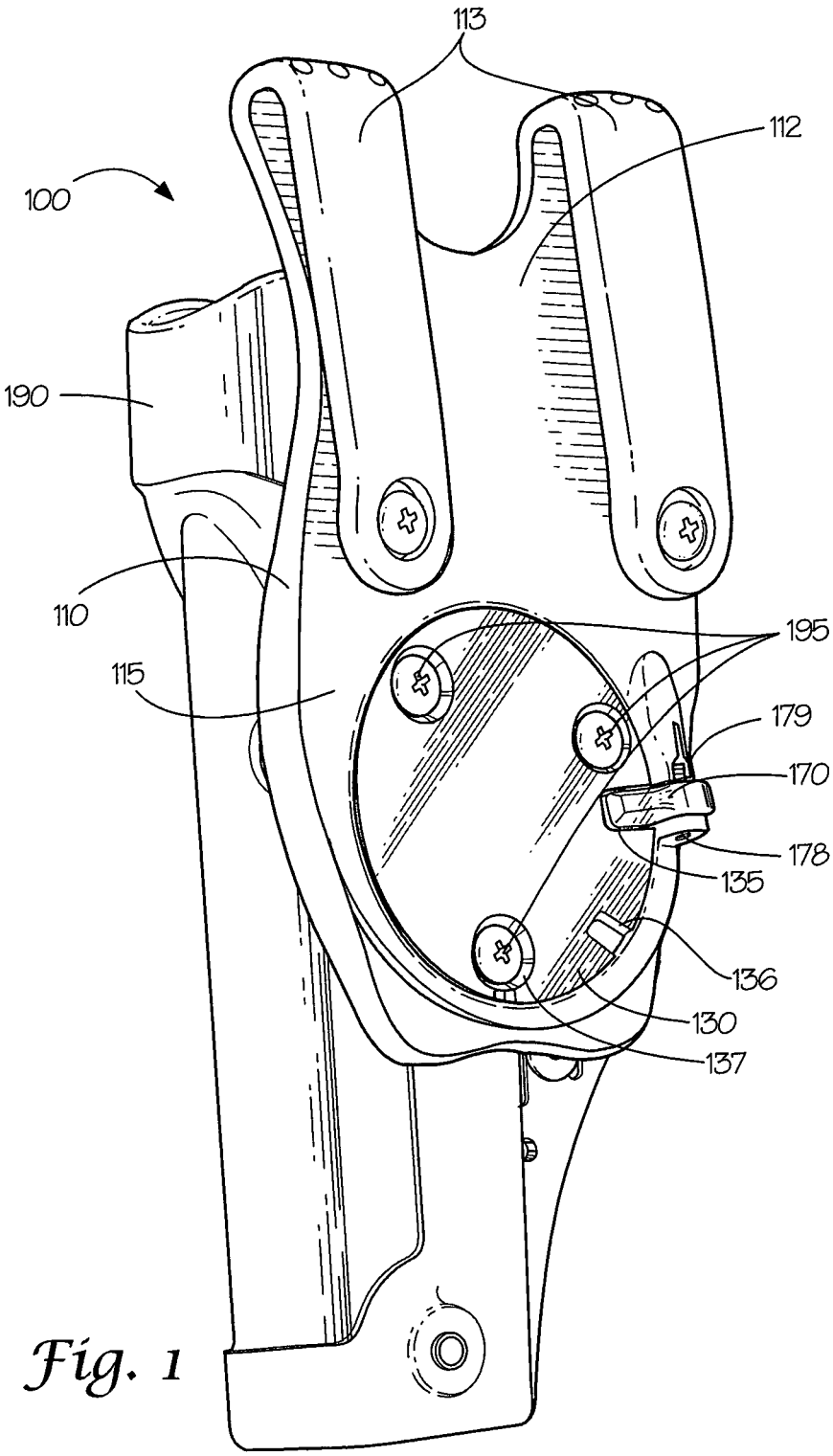
FIG. 1 shows a rear perspective view of a first exemplary embodiment of an accessory attachment platform according to this invention, wherein an attached holster is shown in a normal, carry position.
Figure 2:
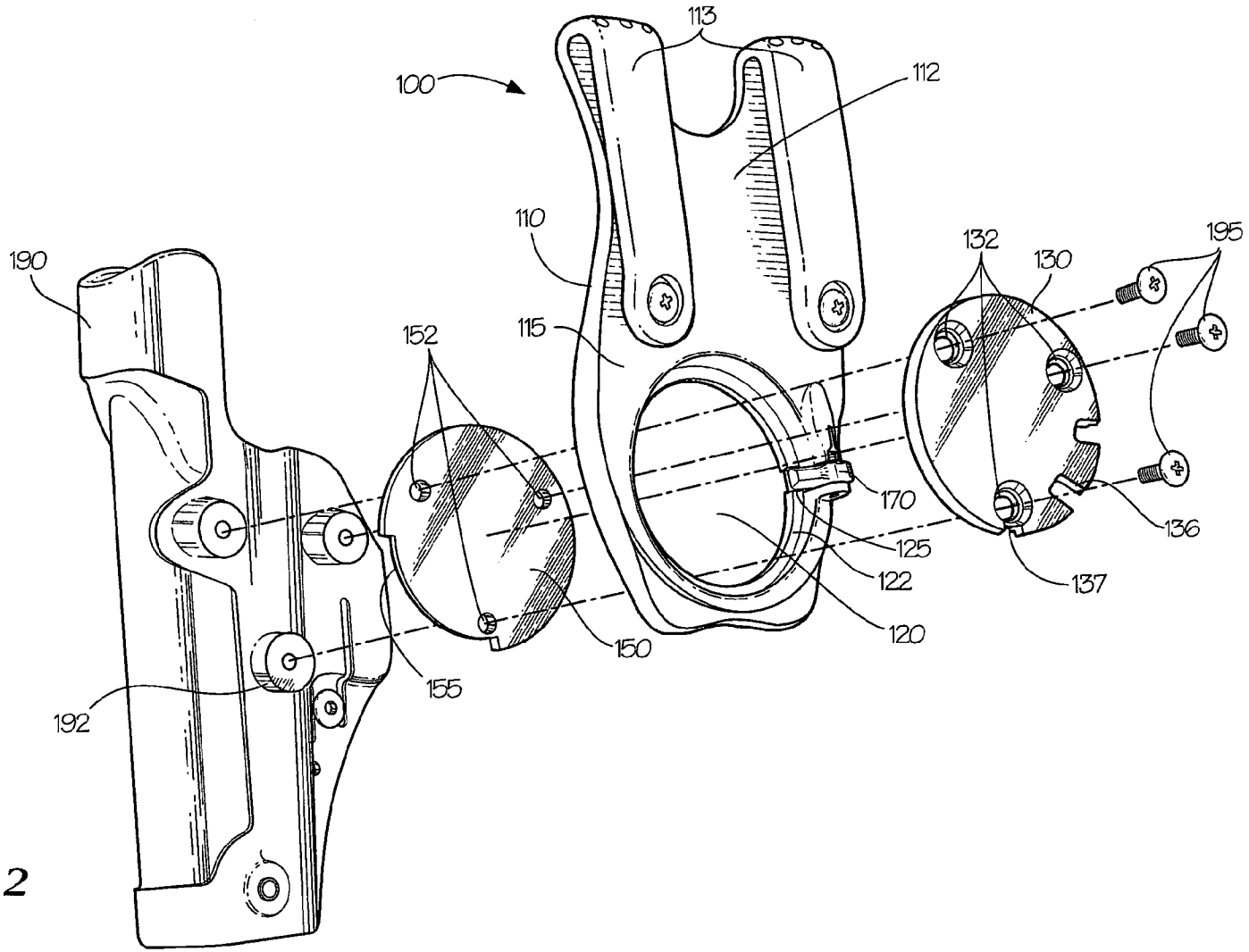
FIG. 2 shows an exploded rear perspective view of a first exemplary embodiment of an accessory attachment platform according to this invention.

The design factors and operating principles of the present invention are explained with reference to various exemplary embodiments of a rotatable accessory attachment platform.

It should be appreciated that, for simplicity and clarification, the embodiments of this invention will be described with reference to a handgun holster being attached to the rotatable accessory attachment platform. However, it should be appreciated that any handgun holster, other holster, accessory carrier, or other carrier, platform, carrier rail (i.e., a Picatinny rail) or device may be removably or permanently attached or coupled to the rotatable accessory attachment platform of this invention. Thus, it should be understood that the rotatable accessory attachment platform of this invention may be utilized in conjunction with any carrier or holder for any handgun, edged weapon, ammunition magazine, less than lethal product (i.e., a taser, pepper spray, mace canister, baton, or the like), radio, flashlight, cellular telephone, personal digital assistants, or other device.

It should also be appreciated that the terms "carrier", "holder", "holster", and "platform" are used for basic explanation and understanding of the operation of the systems, methods, and apparatuses of this invention. Therefore, the terms "carrier", "holder", "holster", and/or "platform" are not to be construed as limiting the systems, methods, apparatuses, or applications of this invention.

Referring now to the drawing figures, FIGS. 1-6 show various views of a first exemplary embodiment of an accessory attachment platform according to this invention. As shown in FIGS. 1-6, the rotatable accessory attachment platform 100 includes at least some of a platform body 110, a platform plate 130, and an accessory plate 150.

The platform body 110 comprises a first side, a second side, a front portion, and a rear portion. Typically, the first side is considered the outer side of the platform body 110 and is worn facing away from a user's body, while the second side is considered the inner side of the platform body 110 and is worn facing against or adjacent the user's body.

Typically, the front portion is worn facing towards the front of a user's body, while the rear portion is worn facing towards the rear of the user's body.

The platform body 110 extends from a belt attachment portion 112 to a plate attachment portion 115.

In various exemplary, nonlimiting embodiments, the belt attachment portion 112 of the platform body 110 is offset from the plate attachment portion 115 of the platform body 110. This offset, if included, provides a gap between the user's hip or leg and the plate attachment portion 115 of the platform body 110. However, it should be appreciated that the inclusion of such an offset is a design choice based upon the desired functionality of the rotatable accessory attachment platform 100.

As illustrated in FIGS. 1-6, the belt attachment portion 112 includes attachment members 113. The attachment members 113 are capable of extending around, receiving, or attaching to, for example, a user's belt, so as to secure the platform body 110 to the user's belt.

Figure 7:
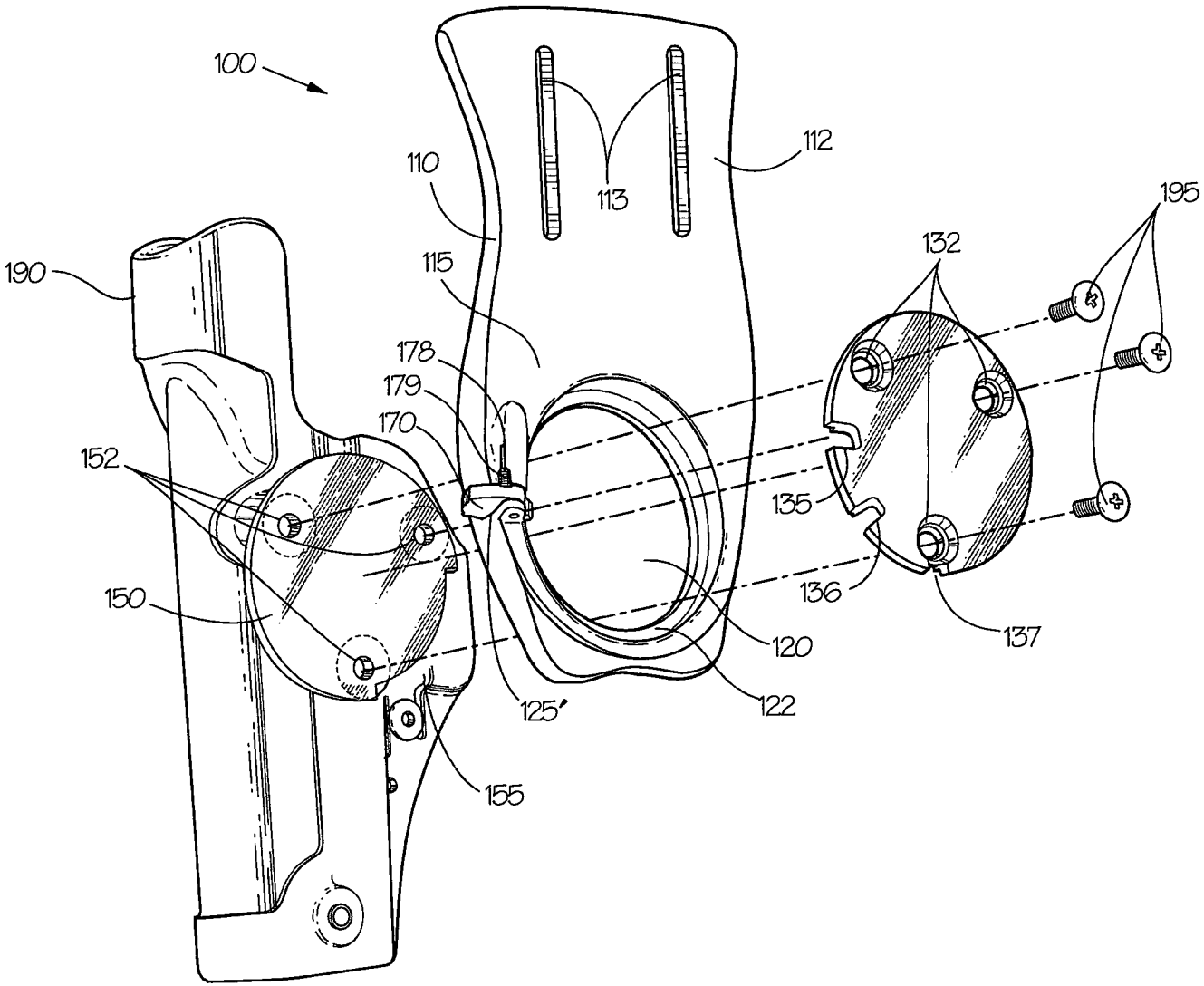
FIG. 7 shows an exploded rear perspective view of a second exemplary embodiment of an accessory attachment platform according to this invention.

It should be appreciated that while attachment members 113 are illustrated as comprising two elongated belt loop members, any number of elongated belt members may be utilized in the belt attachment portion 112. Furthermore, the belt attachment portion 112 may include any number of a variety of attachment members 113 for attaching the platform body 110 to a user's belt, waistband, or other article of clothing. For example, as illustrated in FIG. 7, the attachment members 113 may comprise two or more belt receiving apertures.

A platform opening 120 is formed in the plate attachment portion 115. The platform opening 120 is counter-bored from both the first side of the platform body 110 and the second side of the platform body 110, resulting in an internal projection 122 that extends into a portion of the platform opening 120. Thus, the platform opening 120 is defined by a first, outer diameter, in the areas on either side of the internal projection 122 and a second, inner diameter, in the area of the internal projection 122. Additionally, the internal projection 122 defines a first side wall or shoulder 123, facing towards the first side of the platform body 110, and a second side wall or shoulder 124, facing towards the second side of the platform body 110.

A release lever receiving slot 125 is formed in the rear portion of the plate attachment portion 115. The release lever receiving slot 125 is formed so as to receive at least a portion of a release lever 170. In various exemplary, nonlimiting embodiments, the release lever receiving slot 125 is formed at a position that is approximately 90° to a vertical axis of the platform body 110.

The platform plate 130 has a substantially circular or disk shape and includes a central portion 132 and an outer rim portion 133. As illustrated most clearly in FIG. 4, the central portion 132 and the outer rim portion 133 are sized such that, when the platform plate 130 and the platform body 110 are assembled, the central portion 132 fits within the portion of the platform opening 120 defined by the internal projection 122 (the inner diameter of the platform opening 120) and the outer rim portion 133 of the platform plate 130 fits within the outer diameter of the platform opening 120.

Accordingly, and inner portion of the outer rim portion 133 is capable of rotatably sliding along the surface of the second side wall or shoulder 124 of the internal projection 122, while the central portion 132 is capable of being maintained within the area defined by the inner diameter created by the internal projection 122. In this manner, the platform plate 130 is capable of rotating with respect to the platform body 110 while being restrained from being pulled through the platform opening 120 by the interaction of the outer rim portion 133 and the second side wall or shoulder 124.

The accessory plate 150 also has a substantially circular, disk shape and includes a notch segment 155. The outer circumference of the accessory plate 150 is sized such that, when the accessory plate 150 and the platform body 110 are assembled, the accessory plate 150 fits within the outer diameter of the platform opening 120 such that the accessory plate 150 is capable of rotatably sliding along the surface of the first side wall or shoulder 123 of the internal projection 122, while being maintained within the outer diameter of the platform opening 120. In this manner, the accessory plate 150 is capable of rotating with respect to the platform body 110 while being restrained from being pulled through the platform opening 120 by the interaction of the accessory plate 150 and the first side wall or shoulder 123.

The notch segment 155 is formed so as to interact with the stop 126 formed in the front side of the platform opening 120. The interaction of the notch segment 155 and the stop 126 allows the accessory plate 150 to only rotate a to predetermined number of degrees, as dictated predominantly by the length of the notch segment 155. As illustrated herein, the notch segment 155 provides for approximately 90° of rotation. However, it should be appreciated that the notch segment 155 may be formed so as to allow for greater or reduced rotation of the accessory plate 150.

The platform plate 130 further includes one or more platform plate apertures 132 formed through the platform plate 130, while the accessory plate 150 further includes one or more accessory plate apertures 152 formed through the accessory plate 150. The size and positional relationship of the platform plate apertures 132 and the accessory plate apertures 152 are such that the platform plate apertures 132 and the accessory plate apertures 152 are each capable of simultaneously interacting with corresponding holster body attachment points 192 on the holster 190 and an appropriate attachment means 195 to allow the platform body 100, the platform plate 130, the accessory plate 150, and the holster 190 to be assembled.

Each of the platform plate apertures 132 and the accessory plate apertures 152 is formed so as to be capable of receiving an attachment means 195, which passes therethrough for securing the holster 190, via the holster body attachment points 192, to the platform body 100, the platform plate 130, and the accessory plate 150. Thus, the platform plate apertures 132 and the accessory plate apertures 152, in cooperation with appropriate attachment means 195 and holster body attachment points 192, allow a holster 190 (or any other accessory carriers or mounting devices) to be attached to the rotatable accessory attachment platform 100.

In various exemplary embodiments, the attachment means 195 may comprise screws, snap-together parts, or any other known or later developed means for removably attaching or coupling the platform plate 130 and the accessory plate 150 to cooperating attachment points (not shown) of the holster 190.

In various exemplary embodiments, the shape and positional relationship of the platform plate apertures 132, the accessory plate apertures 152, and the holster body attachment points 192 may be such that simultaneous interaction of only one platform plate aperture 132, accessory plate aperture 152, and holster body attachment point 192 is necessary to assembled the platform body 100, the platform plate 130, the accessory plate 150, and the holster 190.

When the rotatable accessory attachment platform 100 is assembled and, for example, attached to a holster 190, the accessory plate 150 is abutted, on a first in side, to the holster 190. The accessory plate 150 is placed within the platform opening 120 (from a first side of the platform body 110) such that a second side of the accessory plate 150 contacts the surface of the first side wall or shoulder 123. The platform plate 130 is then placed within the platform opening 120 (from a second side of the platform body 110) such that the inner surface of the outer rim portion 133 (on a first side of the platform plate 130) is in contact with the surface of the second side wall or shoulder 124.

Once the platform plate 130, the platform body 110, the accessory plate 150, and in the holster body 190 are appropriately aligned, attachment means 195 are used to secure these components such that the platform body 110 is secured between the platform plate 130 and the accessory plate 150.

In this manner, the platform plate 130, the accessory plate 150, and the holster body 190 are capable of rotating with respect to the platform body 110. The rotational range of motion of the combine platform plate 130, accessory plate 150, and holster body 190, with respect to the platform body 110, is dictated by the interaction of the notch segment 155 and the stop 126.

As illustrated herein, the rotatable accessory attachment platform 100 includes an exemplary holster 190 being attached to the rotatable accessory attachment platform 100. It should be appreciated that the holster 190 may be any type of holster. Additionally, while a holster 190 is illustrated, it should be understood that the rotatable accessory attachment platform 100 of this invention may be utilized in conjunction with any carrier or holder for any handgun, edged weapon, ammunition magazine, less than lethal product (i.e., a taser, pepper spray, mace canister, baton, or the like), radio, flashlight, cellular telephone, personal digital assistants, or other device.

Figure 4:
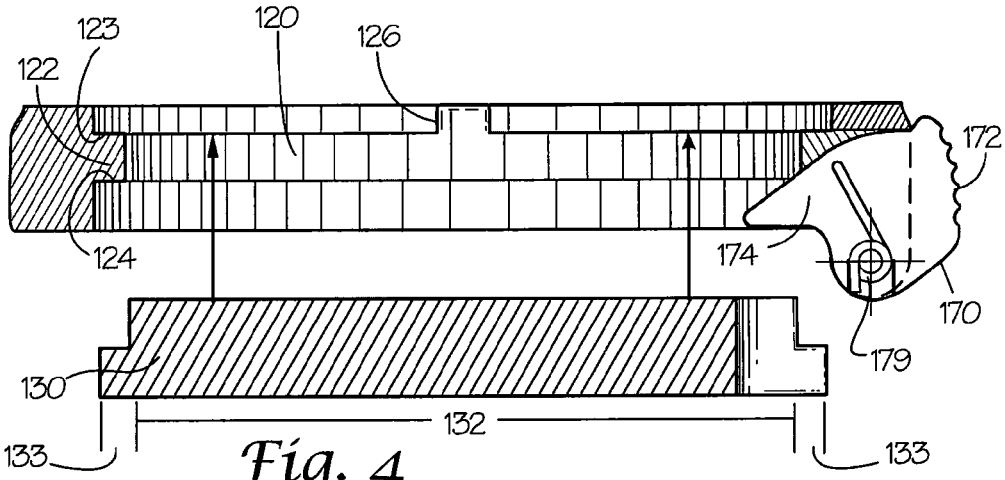
FIG. 4 shows a partially exploded cross-sectional view, taken along line 5A-5A of FIG. 3A.
Figure 5A:
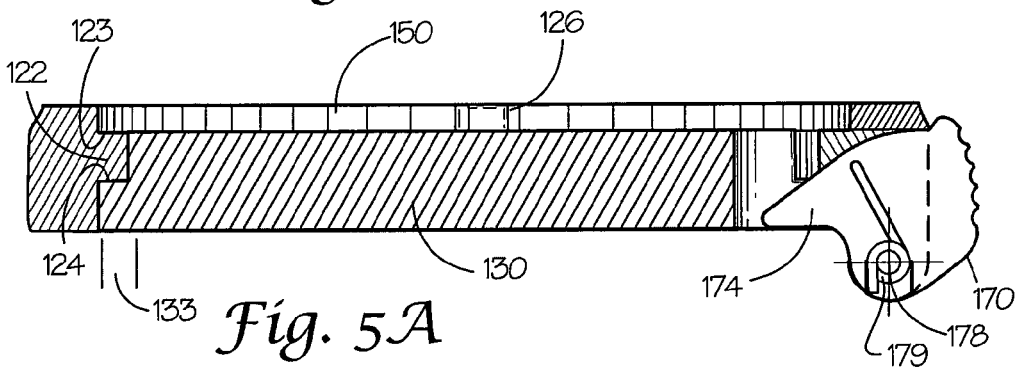
FIG. 5A shows a cross-sectional view, taken along line 5A-5A of FIG. 3A, illustrating the accessory attachment platform in a normal, carry position.
Figure 5B:
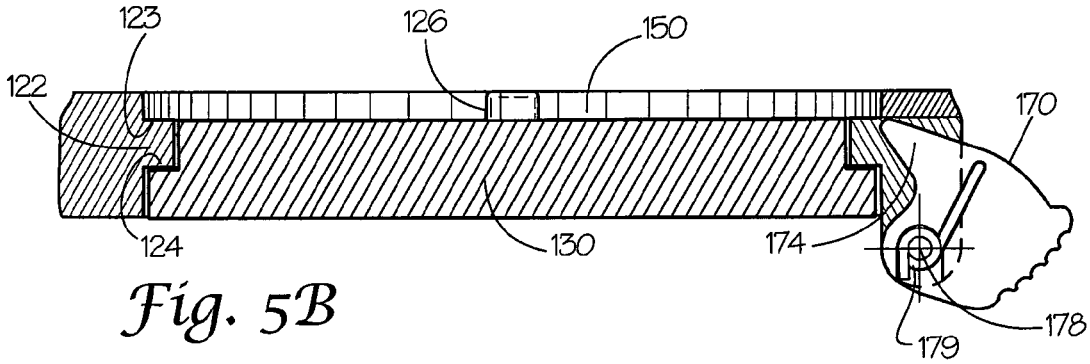
FIG. 5B shows a cross-sectional view illustrating the accessory attachment platform at an intermediate angular position between the angular position illustrated by line 5A-5A of FIG. 3A and line 5C-5C of FIG. 3B.
Figure 5C:
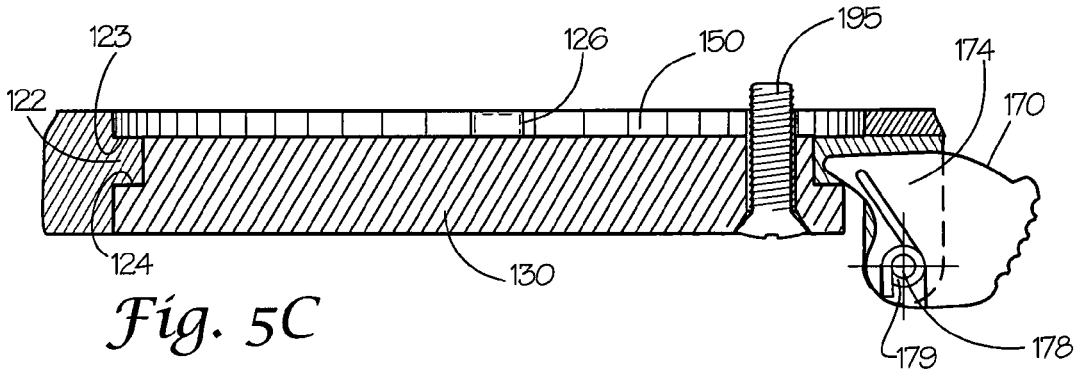
FIG. 5C shows a cross-sectional view, taken along line 5C-5C of FIG. 3B, illustrating the accessory attachment platform in a rotated position.
Figure 6:
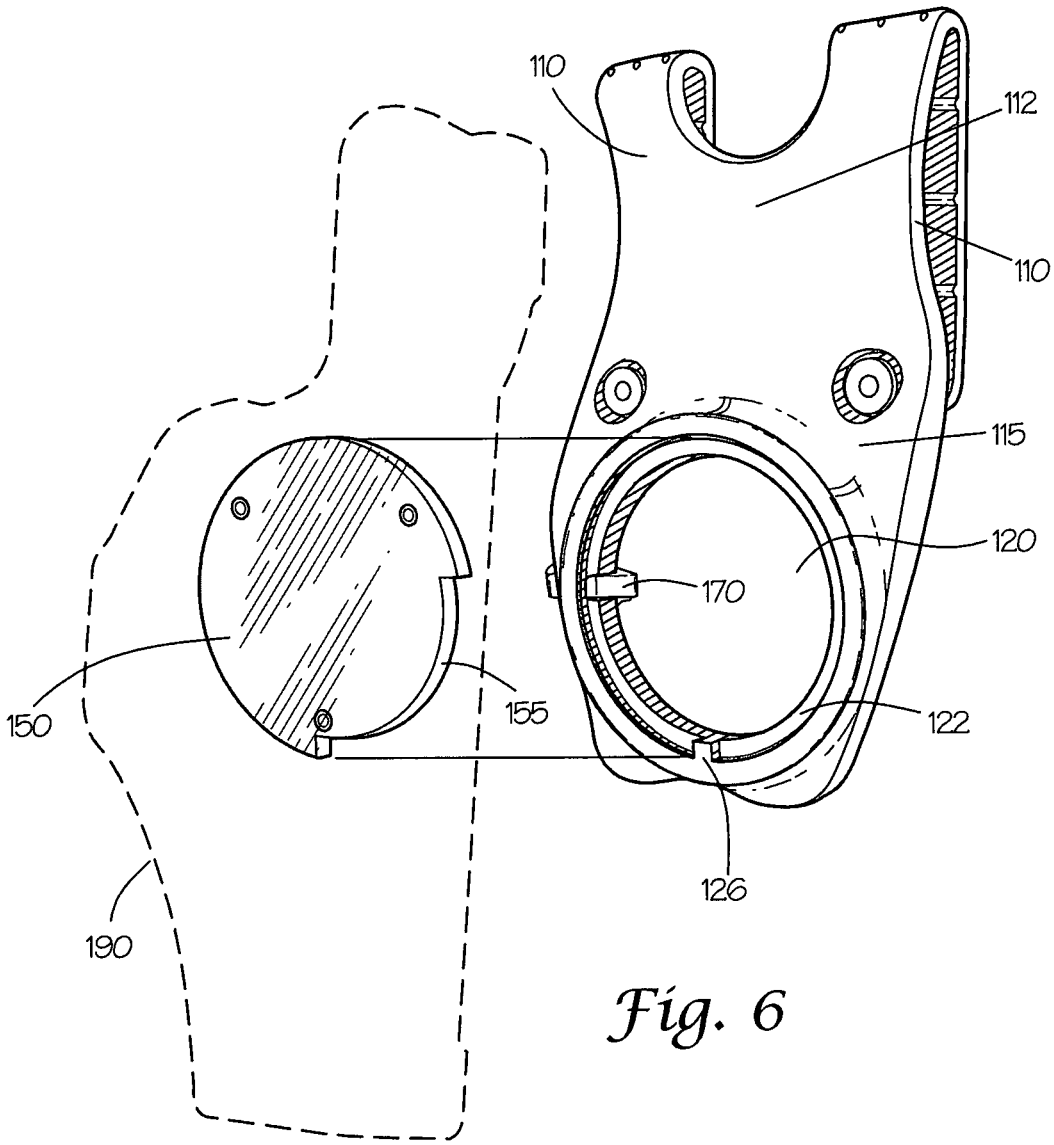
FIG. 6 shows partial exploded front perspective view of a first exemplary embodiment of an accessory attachment platform according to this invention.

The platform plate release lever 170, as shown in greater detail in FIGS. 4-5C, comprises at least some of a thumb/finger engagement portion 172 and a plate engagement portion 174. The thumb/finger engagement portion 172 and the plate engagement portion 174 are generally separated by a fulcrum or pivot pin 178.

In various exemplary embodiments, the thumb/finger engagement portion 172 is smooth and non-textured. Alternatively, at least one surface of the thumb/finger engagement portion 172 may include a textured or serrated portion (as illustrated) so that the thumb/finger engagement portion 172 may be distinguished tactilely from other portions of the release lever 170 or the rotatable accessory attachment platform 100 and to aid the user's thumb/finger as the user's thumb/finger applies a pivoting force to the release lever 170 and pivots the release lever 170 to a release position.

In various exemplary, non-limiting embodiments, release lever 170 is pivotally connected within the lever receiving slot 125, via a fulcrum or pivot pin 178. In various exemplary embodiments, the pivot pin 178 is positioned substantially parallel to a vertical axis of the platform body 110. However, it should be appreciated that the pivot pin 178 may be positioned at any angle relative to a vertical axis of the platform body 110.

Figures 8, 9A, 9B:
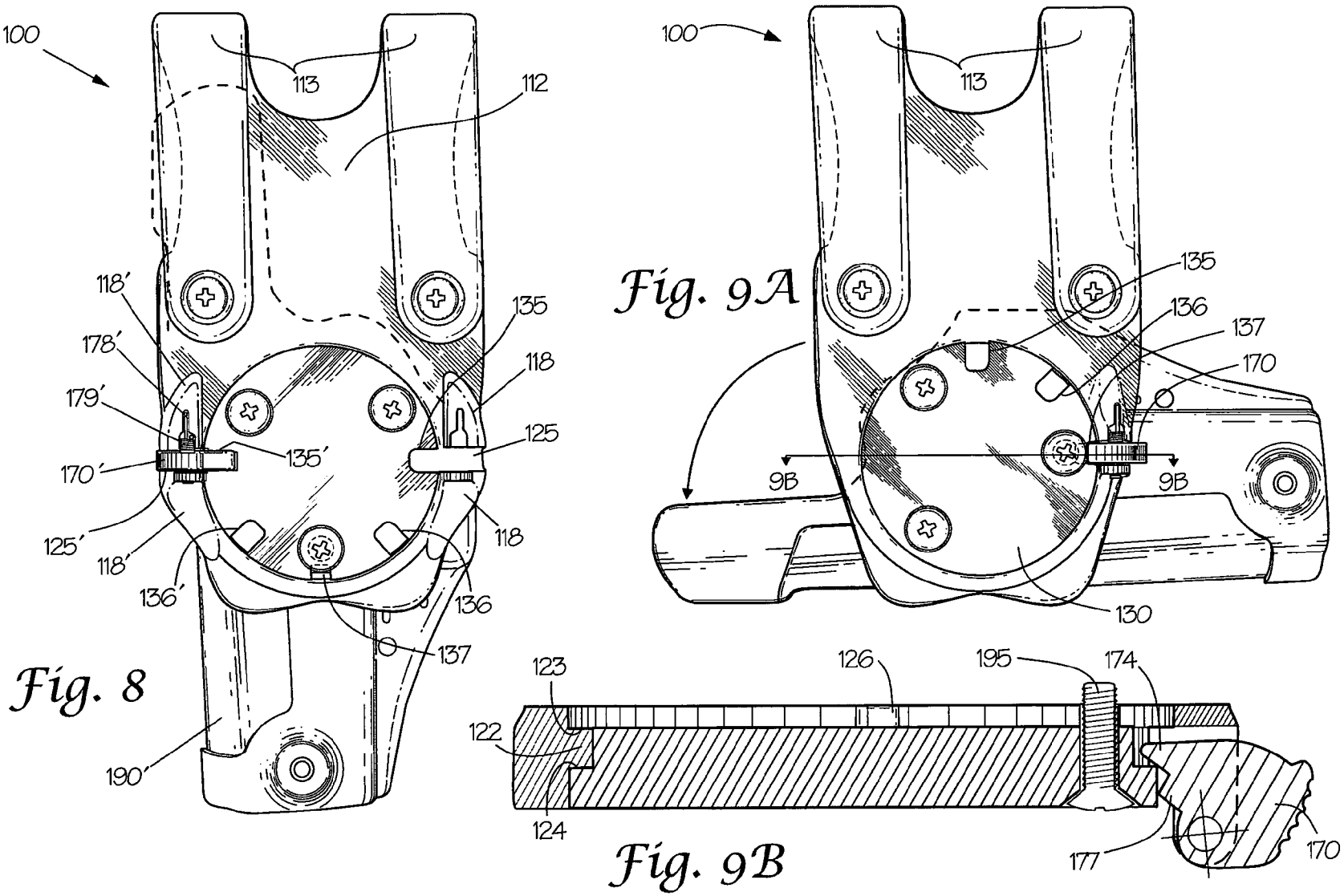
FIG. 8 shows a rear elevational view of a third exemplary embodiment of an accessory attachment platform according to this invention, wherein an attached holster is shown in a normal, carry position.
FIG. 9A shows a rear elevational view of a fourth exemplary embodiment of an accessory attachment platform according to this invention, wherein an attached holster is shown in a rotated position.
FIG. 9B shows a cross-sectional view, taken along line 9B-9B of FIG. 9A, illustrating the accessory attachment platform in a rotated position.
Figure 11:
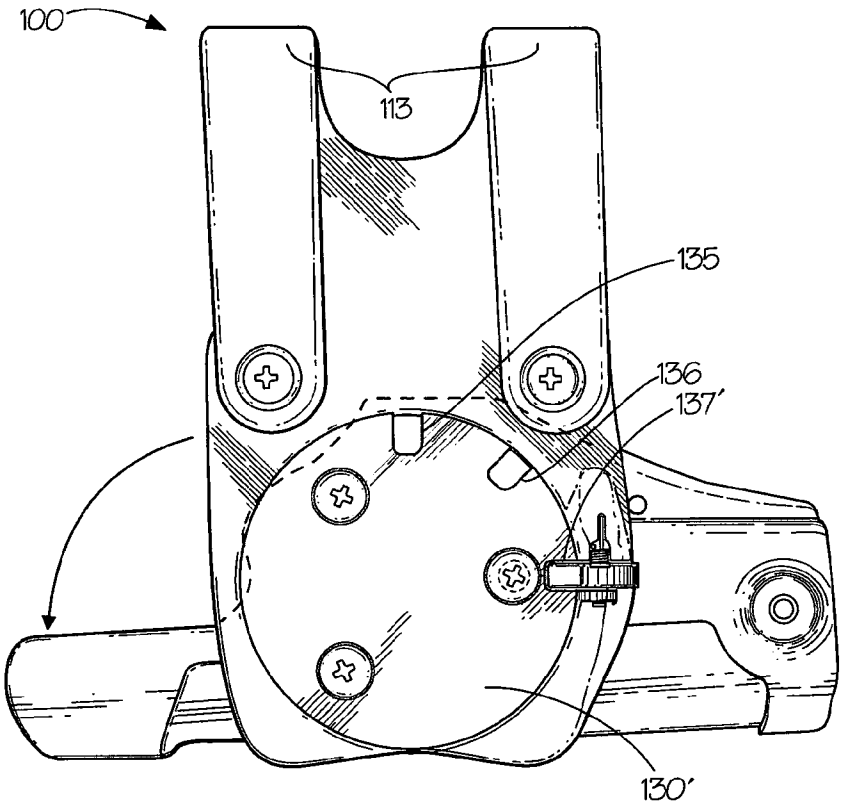
FIG. 11 shows a rear elevational view of the fifth exemplary embodiment of the accessory attachment platform according to this invention, wherein the attached holster is shown in a rotated position.
Figure 10:
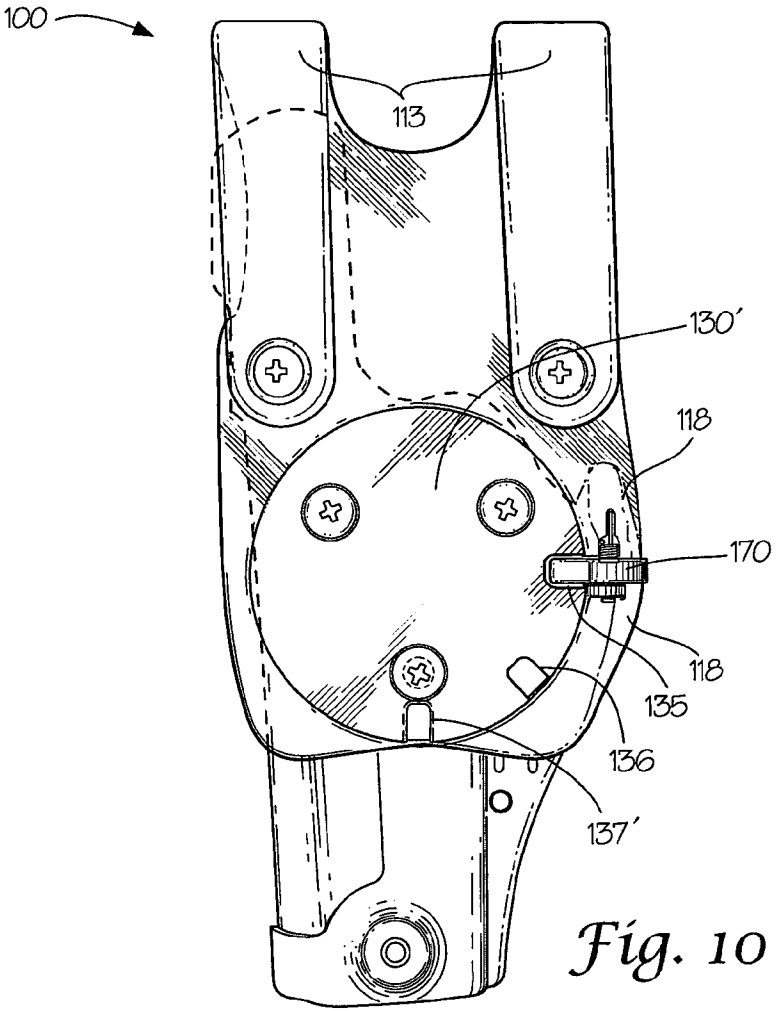
FIG. 10 shows a rear elevational view of a fifth exemplary embodiment of an accessory attachment platform according to this invention, wherein an attached holster is shown in a normal, carry position.

In various exemplary embodiments, as illustrated in FIGS. 8, 10, and 11, a ridge 118 is formed around at least a portion of the release lever 170. Generally, the ridge 118 does not contact the release lever 170, but provides a perimeter around at least a portion of the release lever 170 to reduce the likelihood of the release lever 170 being inadvertently manipulated and to keep items from accidentally snagging or hooking the release lever 170.

The ridge 118 may include a textured portion (not shown). In this manner, the ridge 118 may be distinguished tactilely from other portions of the platform body 110 or the release lever 170.

The release lever 170 is pivotable between a locking position and an unlocking position. When the release lever 170 is in the locking position, the plate engagement portion 174 extends into a portion of the platform opening 120, as illustrated in FIGS. 4 and 5A.

In various exemplary embodiments, the plate engagement portion 174 may include a ramped or tapered surface on one or both sides of the plate engagement portion 174. The ramped or tapered surface, if included, may aid in the seating of the plate engagement portion 174 in the primary notch 135 and/or the secondary notch 137. Additionally, the ramped or tapered surface may aid in forcing the plate engagement portion 174 from the secondary notch 137, as described below.

In various exemplary embodiments, the release lever 170 is biased to the locking position by, for example, a spring means or biasing means 179. In various exemplary embodiments, the spring means or biasing means 179 comprises a portion of spring steel or a spring-biased coil. Alternatively, the spring means or biasing means 179 may comprise an extension or finger that extends from either the release lever 170 or a portion of the body 110 that provides a biasing force to the release lever 170 relative to the body 110.

When the bias of the release lever 170 is overcome and the release lever 170 is pivoted from the locking position to the unlocking position, the plate engagement portion 174 is withdrawn from the platform opening 120, as illustrated in FIG. 5B. When the pivoting force is removed from the release lever 170, the release lever 170 returns to the biased locking position.

At least one primary notch 135 is formed in the platform plate 130. In various exemplary embodiments, at least one secondary notch 137 is also formed in the platform plate 130. The at least one primary notch 135 is formed at a position that allows the plate engagement portion 174 of the release lever 170 to interact with the primary notch 135 when the holster body 190 is in the normal, carry position, as illustrated in FIGS. 1, 3A, 8, and 10, so as to receive at least a portion of the plate engagement portion 174 of the release lever 170, when the release lever 170 is in the locking position.

Figure 3B:
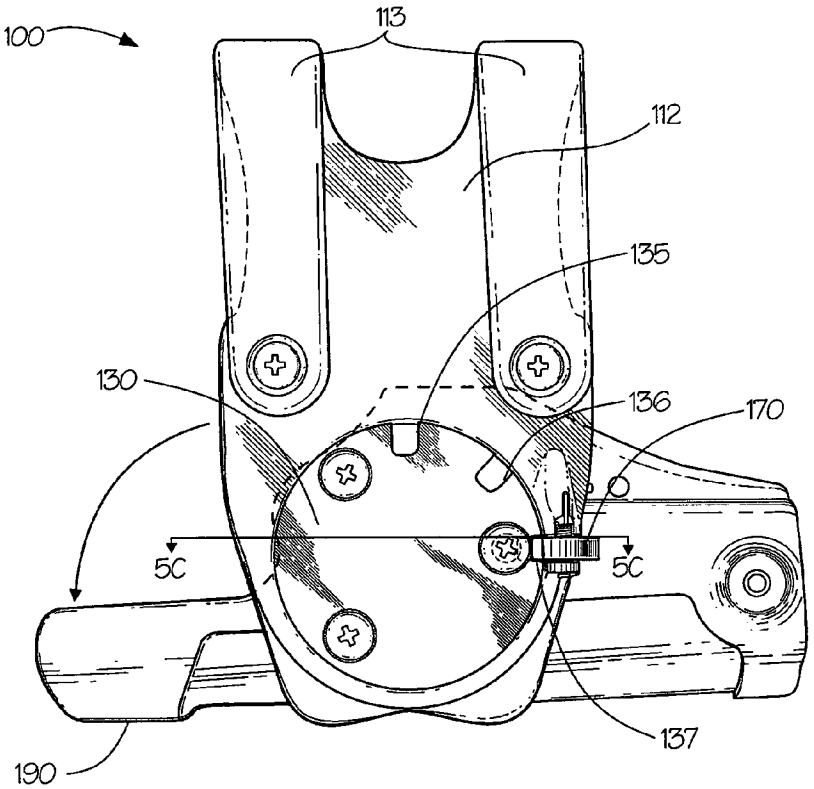
FIG. 3B shows a rear elevational view of a first exemplary embodiment of an accessory attachment platform according to this invention, wherein an attached holster is shown in a rotated position.
Figure 3A:
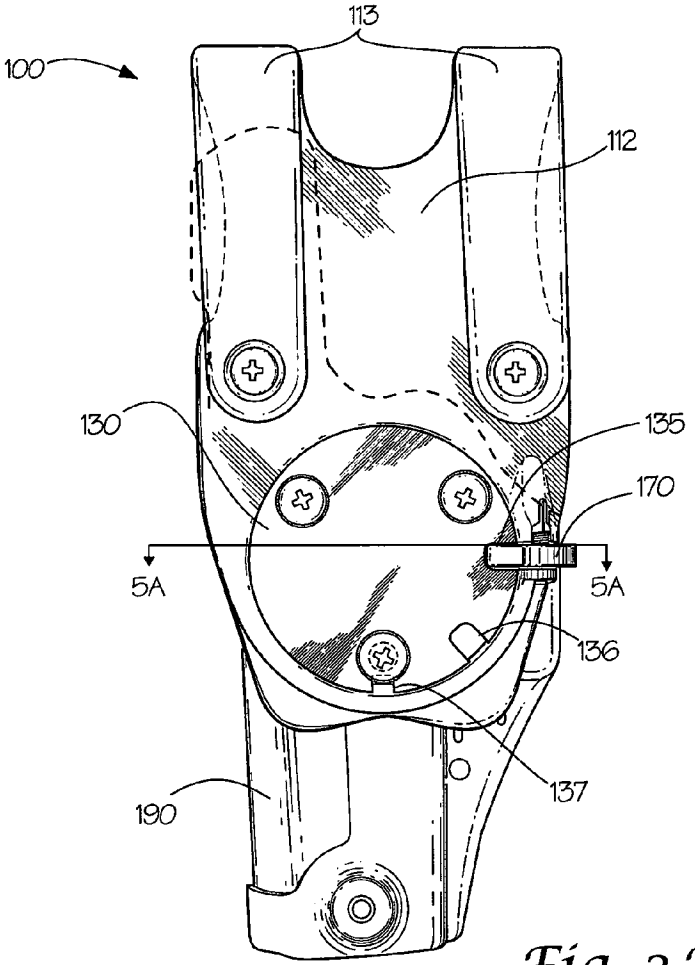
FIG. 3A shows a rear elevational view of a first exemplary embodiment of an accessory attachment platform according to this invention, wherein an attached holster is shown in a normal, carry position.

The secondary notch 137, if included, is formed at a position that allows the plate engagement portion 174 of the release lever 170 to interact with the secondary notch 137 when the holster body 190 is in a rotated position, as illustrated in FIGS. 3B, 9A, and 11, so as to receive at least a portion of the plate engagement portion 174 of the release lever 170, when the release lever 170 is in the locking position.

During use of the rotatable accessory attachment platform 100 (within attached holster 190), the holster 190 is initially presented in a normal, carry position, as illustrated in FIGS. 1, 3A, 8, and 10. When in the normal, carry position, the plate engagement portion 174 extends into the primary notch 135, as illustrated in FIG. 5A, such that the platform plate 130 is unable to rotate relative to the platform body 110.

If the user desires to rotate the holster 190 from the normal, carry position, the user contacts the thumb/finger engagement portion 172 of the release lever 170, overcomes any bias of the release lever 170, and pivots the release lever 170 from the locking position to the unlocking position.

When the release lever 170 is pivoted from the locking position to the unlocking position, the plate engagement portion 174 of the release lever 170 is withdrawn from the platform opening 120 and the primary notch 135, as illustrated in FIG. 5B.

As illustrated in FIG. 5B, once the plate engagement portion 174 of the release lever 170 is sufficiently withdrawn from the primary notch 135, the holster 190 may be rotated from the normal, carry position towards the rotated position (as indicated by the arrow in FIG. 3B).

Once the holster 190 has been rotated to the rotated position and the pivoting force is removed from the release lever 170, the release lever 170 returns to the biased locking position and engages at least a portion of the secondary notch 137, as illustrated in FIG. 5C. Thus, for example, a user is able to rotate the holster 190 to a rotated position before being seated.

It should be appreciated that, depending upon the relative sizes of the plate engagement portion 174 and the secondary notch 137, the plate engagement portion 174, when in the locking position, may extend far enough into the secondary notch 137 to maintain the platform plate 130 in the rotated position.

Alternatively, the plate engagement portion 174 may only extend far enough into the secondary notch 137 to loosely maintain the platform plate 130 in the rotated position. If the plate engagement portion 174 only loosely maintains the platform plate 130 in the rotated position, a user may simply apply a counter rotating force to the holster 190 to overcome the bias of the release lever 170, force the plate engagement portion 174 from the secondary notch 137, and allow the holster 190 to be rotated to the normal, carry position.

In various exemplary, nonlimiting embodiments, one or more additional, optional notches 136 may be included in the platform plate 130. These additional notches, if included, may allow the platform plate 130 to be engaged by the release lever 170 at various, predetermined points. Therefore, utilizing additional notches 136, the holster body 190 may be maintained in a variety of rotational or angular positions, relative to the platform body 110.

FIG. 7 shows a second exemplary embodiment of an accessory attachment platform 100 according to this invention, wherein the lever receiving slot 125 is removed from the rear portion of the platform body 110 and replaced with a lever receiving slot 125' located in a front portion of the platform body 110. In this manner, instead of being located along a rear portion of the platform body 110 (as is the case with the lever receiving slot 125), the release lever 170 may be positioned along a front portion of the platform body 110.

As illustrated in FIG. 8, a lever receiving slot 125 may be formed in a rear portion of the platform body 110, while a second lever receiving slot 125' may be formed in a front portion of the platform body 110. In this manner, the release lever 170 may optionally be positioned in either of the lever receiving slots 125 or 125'.

FIGS. 9A and 9B illustrate an accessory attachment platform 100 having a modified release lever 170. As illustrated most noticeably in FIG. 9B, the release lever 170 includes an additional protrusion or step 177 along a portion of the plate engagement portion 174. The inclusion of the step 177 allows the release lever 170 to more fully engage the secondary notch 137 of the platform plate 130. In various exemplary embodiments, the step 177 allows the plate engagement portion 174 to more closely match in internal shape of the secondary notch 137.

FIGS. 10 and 11 illustrate an additional exemplary embodiment of the current invention. As illustrated in FIGS. 10 and 11, the platform plate 130 is replaced with a platform plate 130'. The platform plate 130' has it and increased diameter, such that secondary notch 137' has a size that more closely approximates the size of the primary notch 135. In this manner, the release lever 170, and more particularly the plate engagement portion 174, may be fully received within not only the primary notch 135, but also the secondary notch 137'. Thus, the holster 190 may be positively locked in either the normal, carry position, as illustrated in FIG. 10, but also in the rotated position, as illustrated in FIG. 11.

Figure 12:
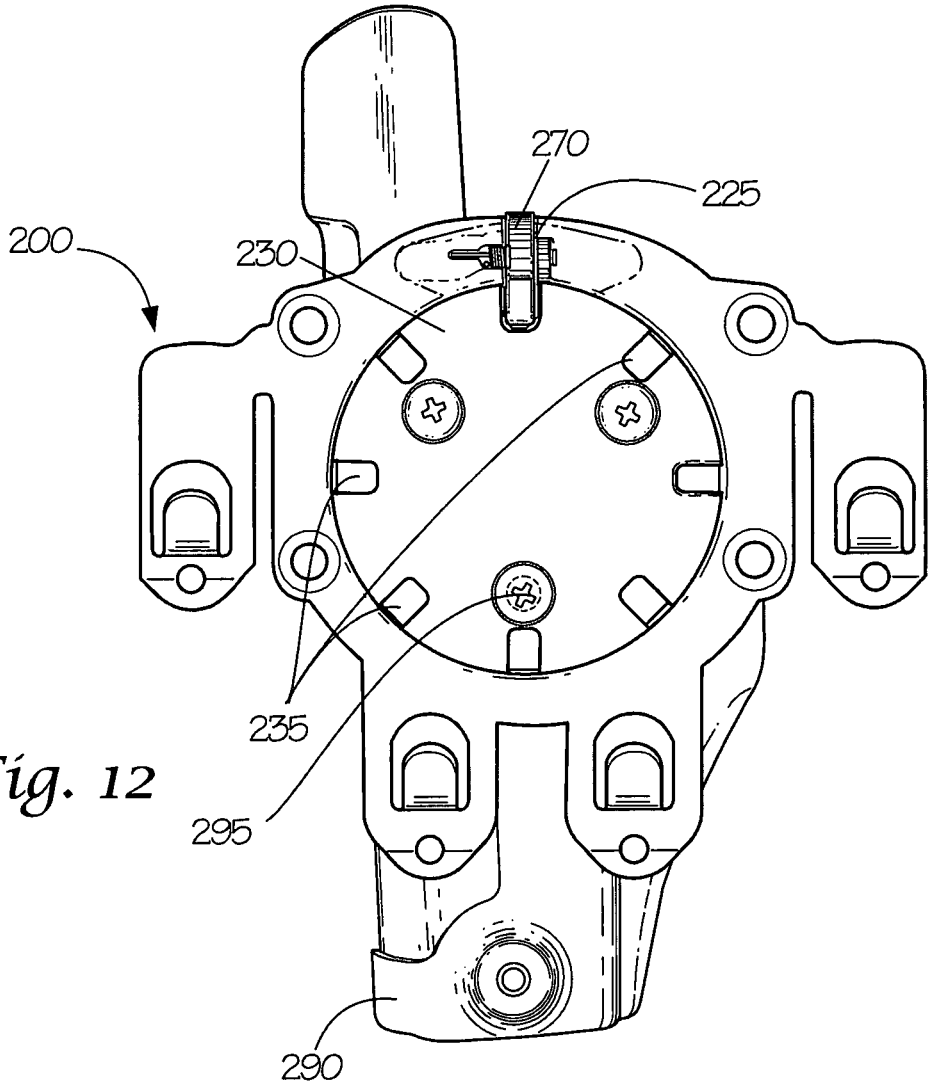
FIG. 12 shows a rear elevational view of a sixth exemplary embodiment of an accessory attachment platform according to this invention, wherein the platform body comprises a universal mounting platform that is capable of being removably attached or coupled to a portion of MOLLE or S.T.R.I.K.E. webbing.

FIG. 12 shows a rear elevational view of a sixth exemplary embodiment of an accessory attachment platform according to this invention. In the accessory attachment platform 200, the platform body 110, as described above with respect to FIGS. 1-11, is replaced with a universal mounting platform 210 that is capable of being removably attached or coupled to a portion of MOLLE or S.T.R.I.K.E. webbing. In various exemplary embodiments, the universal mounting platform is as described in U.S. patent application Ser. No. 11/906,629, filed Oct. 3, 2007, and entitled Universal Mounting Platform, the disclosure of which is incorporated herein by reference.

As illustrated in FIG. 12, the universal mounting platform 210 includes a platform opening 220, which is capable of receiving a platform plate 230 and an accessory plate 250, each of which have features similar to the platform opening 120, the platform plate 130, and the accessory plate 150.

However, as illustrated in FIG. 12, the release lever 270 is positioned proximate a top portion of the universal mounting platform 210. Additionally, a plurality of primary notches 235 is included around the platform plate 230. Thus, the holster 290 may be secured at a variety of desired angles relative to the universal mounting platform 210.

While the primary notches 235 are illustrated as being positioned at approximately 45° increments around the platform plate 230, it should be appreciated that the number and position of any included primary notches 235 is a design choice based upon the desired functionality of the rotatable accessory attachment platform 200.

In various exemplary embodiments, the rotatable accessory attachment platform 200 can be mounted directly to a surface (i.e., a piece of furniture, a side of a counter or desktop, a vehicle console, shipboard bulkhead, etc.) as opposed to being worn by a user. In these exemplary embodiments, an attachment means may be used to attach or couple the platform 200 directly to the surface. Alternatively, one or more spacers may be included between the platform 200 and the mounting surface so as to provide sufficient space between the platform 200 and mounting surface to allow proper function and operation of the lock 270 and/or to allow the user to rotate the attached holster or accessory carrier.

In these exemplary embodiments, the overall size and shape of the platform 200 may be modified (i.e., attachment arms removed and/or additional or varied mounting apertures or holes provided). Additionally, the thickness of the platform 200 may be modified.

Figure 13:
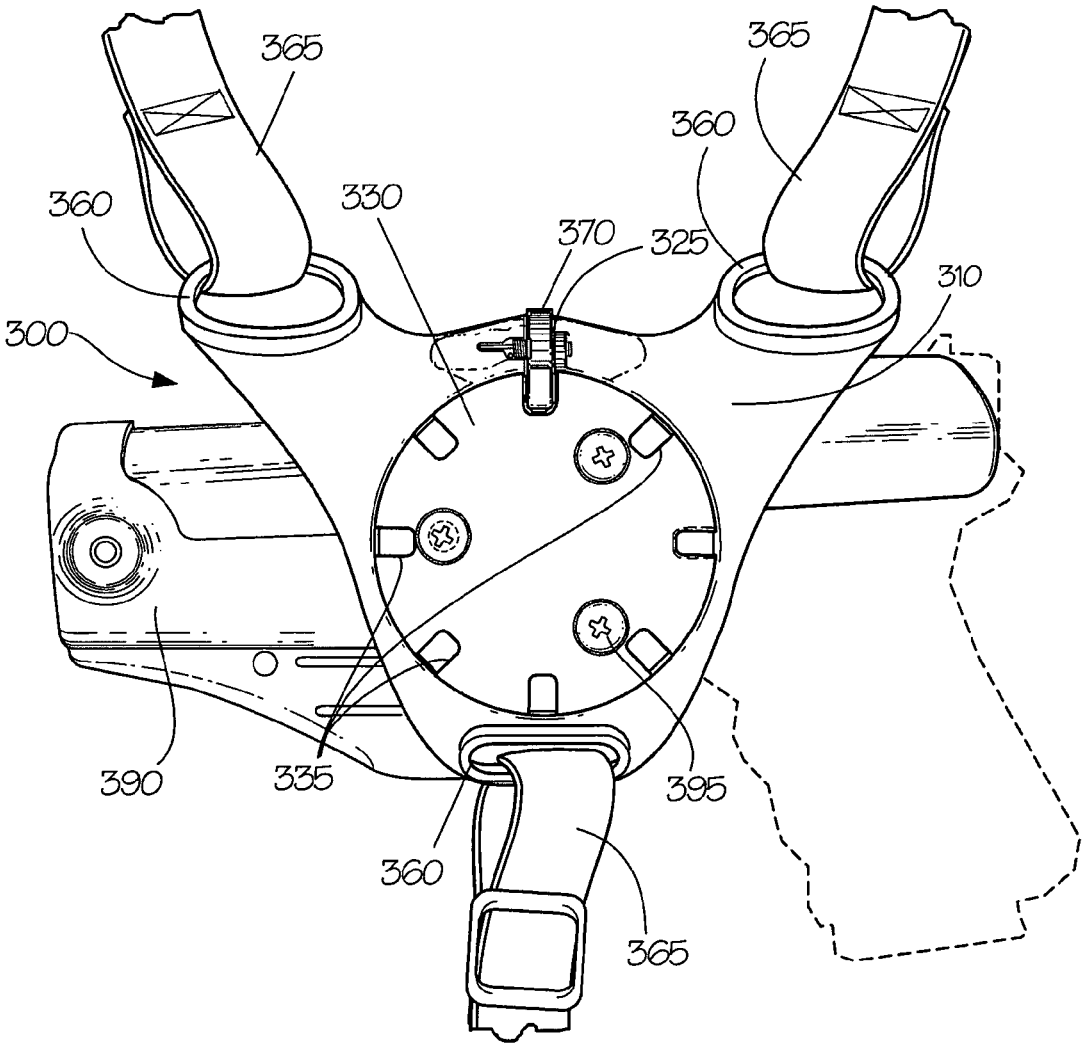
FIG. 13 shows a rear elevational view of a seventh exemplary embodiment of an accessory attachment platform according to this invention, wherein the platform body comprises a mounting platform that is capable of being attached or coupled to a portion of webbing or strap material.

FIG. 13 shows a rear elevational view of a seventh exemplary embodiment of an accessory attachment platform according to this invention. In the accessory attachment platform 300, the platform body 110, as described above with respect to FIGS. 1-11, is replaced with a mounting platform 310 that is capable of being attached or coupled to a portion of webbing or strap material, such as, for example, the strap material used to form a shoulder holster.

As illustrated in FIG. 13, the mounting platform 310 of the accessory attachment platform 300 includes a platform opening 320, which is capable of receiving a platform plate 330 and an accessory plate 350, each of which have features similar to the platform opening 120, the platform plate 130, and the accessory plate 150. As illustrated, the mounting platform 310 further includes three apertures 360, formed through the mounting platform 310, which are capable of being attached or coupled to a portion of webbing or strap material 365.

As further illustrated in FIG. 13, the release lever 370 is positioned proximate a top portion of the mounting platform 310. Additionally, a plurality of primary notches 335 is included around the platform plate 330. Thus, the holster 390 may be secured at a variety of desired angles relative to the mounting platform 310.

It should be appreciated that while the mounting platform 310 is illustrated as including three webbing or strap receiving apertures (one strap receiving aperture 360 proximate a lower portion of the mounting platform 310 and two strap receiving apertures 360 proximate and upper portion of the mounting platform 310), the number and position of strap receiving apertures 360 is a design choice based upon desired functionality of the accessory attachment platform 300.

It should also be appreciated that while the release lever 370 is illustrated as being positioned proximate a top portion of the mounting platform 310, the release lever 370 may be positioned at any position around the mounting platform 310.

Likewise, while the primary notches 335 are illustrated as being positioned at approximately 45° increments around the platform plate 330, it should be appreciated that the number and position of any included primary notches 335 is a design choice based upon the desired functionality of the rotatable accessory attachment platform 300.

While this invention has been described in conjunction with the exemplary embodiments outlined above, the foregoing description of exemplary embodiments of the invention, as set forth above, are intended to be illustrative, not limiting, and the fundamental invention should not be considered to be necessarily so constrained. It is evident that the invention is not limited to the particular variation set forth and many alternatives, adaptations modifications, and/or variations will be apparent to those skilled in the art. For example, while the accessory plate 150 has been described as being a separate component that is attachable to the holster body 190, it should be appreciated that the accessory plate 150 may be permanently attached to the holster body 190 or integrally formed as a portion of the holster body 190.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the description of exemplary embodiments, as set forth above, will reveal the general nature of the invention, such that others may, by applying current knowledge, change, vary, modify, and/or adapt these exemplary embodiments for various applications without departing from the spirit and scope of the invention. Any and all such changes, variations, modifications, and/or adaptations should and are intended to be comprehended within the meaning and range of equivalents of the disclosed exemplary embodiments and may be substituted without departing from the true spirit and scope of the invention.

What is claimed is:

1. A platform, comprising:

a platform body having a plate attachment portion, wherein said plate attachment portion includes a platform opening, wherein said platform opening includes an internal projection that extends into a portion of said platform opening;

a platform plate portion coupled to an accessory plate portion, through said platform opening, such that said platform plate portion and said accessory plate portion are rotatable relative to said platform body, wherein a portion of said platform plate portion is rotatably slidable along a surface of said internal projection, and wherein a portion of said accessory plate portion is rotatably slidable along a surface of said internal projection; and a release lever pivotably attached to said platform body, wherein said release lever is pivotable between a locking position and an unlocking position, and wherein said release lever is capable of releasably interacting with a primary notch of said platform plate portion.

2. The platform of claim 1, wherein said platform opening is counter-bored from a first side of said platform body and a second side of said platform body to form said internal projection.

3. The platform of claim 1, wherein said internal projection includes a first shoulder, facing towards said first side of said platform body, and a second shoulder, facing towards said second side of said platform body.

4. The platform of claim 1, wherein an outer rim portion of said platform plate portion is rotatably slidable along a surface of said second shoulder of said platform opening.

5. The platform of claim 1, wherein an outer rim portion of said accessory plate portion is rotatably slidable along a surface of said first shoulder of said platform opening.

6. The platform of claim 1, wherein said release lever is capable of releasably interacting with a primary notch of said platform plate portion such that when said release lever is in said locking position relative to said primary notch of said platform plate portion, said platform plate portion is unable to rotate relative to said platform body.

7. The platform of claim 1, wherein said platform plate portion has a substantially circular or disk shape.

8. The platform of claim 1, wherein said accessory plate portion has a substantially circular or disk shape.

9. The platform of claim 1, further including a notch segment formed in said accessory plate portion that interacts with a stop formed in said platform opening to allow said accessory plate portion to only rotate a predetermined number of degrees relative to said platform body, as dictated by said notch segment.

10. The platform of claim 9, wherein said notch segment is formed so as to allow for less than, equal to, or greater than 90° of rotation of said accessory plate portion relative to said platform body.

11. The platform of claim 1, wherein said platform plate portion further includes one or more platform plate portion apertures formed therethrough and wherein said accessory plate portion further includes one or more accessory plate portion apertures formed therethrough.

12. The platform of claim 1, wherein said release lever is biased to a locking position such that when a pivoting force is removed from said release lever, said release lever returns to said locking position.

13. The platform of claim 1, wherein said release lever is in said unlocking position, relative to said primary notch of said platform plate portion, said platform plate portion is able to rotate relative to said platform body.

14. The platform of claim 1, further including at least one secondary notch formed in said platform plate portion such that when said release lever is in said locking position, relative to said secondary notch of said platform plate portion, said platform plate portion is unable to rotate relative to said platform body.

15. The platform of claim 14, wherein when said release lever is in said locking position, relative to said secondary notch of said platform plate portion, a counter rotating force can be applied to said accessory plate portion sufficient to force said release lever from said secondary notch and allow said accessory plate portion to be rotated relative to said platform body.

16. The platform of claim 1, wherein said release lever is located along a rear portion or a front portion of said platform body.

17. The platform of claim 1, wherein said release lever is positioned proximate a top portion, a bottom portion, or a side portion of said accessory plate portion.

18. The platform of claim 1, wherein said accessory plate portion includes an attached carrier, platform, carrier rail, or device.

19. The platform of claim 1, said accessory plate portion includes a carrier, platform, carrier rail, or device formed as an integral part of said accessory plate portion.

20. A platform, comprising:

a platform body having a plate attachment portion, wherein said plate attachment portion includes a platform opening, wherein said platform opening includes a projection that extends into a portion of said platform opening;

a platform plate portion coupled to an accessory plate portion, through said platform opening, such that said platform plate portion and said accessory plate portion are rotatable relative to said platform body, wherein a portion of said platform plate portion is rotatable slidable along a surface of said projection, and wherein a portion of said accessory plate portion is rotatably slidable along a surface of said projection; and a release lever pivotably attached to said platform body, wherein said release lever is pivotable between a locking position and an unlocking position, and wherein said release lever is capable of releasably interacting with a primary notch of said platform plate portion such that when said release lever is in said locking position relative to said primary notch of said platform plate portion, said platform plate portion is unable to rotate relative to said platform body.

* * * * *

UNITED STATES PATENT AND TRADEMARK OFFICE

CERTIFICATE OF CORRECTION

PATENT NO. : 8,469,245 B2
APPLICATION NO. : 13/566065
DATED : June 25, 2013
INVENTOR(S) : Thomas M. Gregory, Robert A. Kincaid and Thomas A. Marx It is certified that error appears in the above-identified patent and that said Letters Patent is hereby corrected as shown below:

In the Specification:

Column 2, Line 9, delete "attaching a handgun holster or other to accessory carrier to a" and insert --attaching a handgun holster or other accessory carrier to a--.

Column 5, beginning on Line 54, delete "allows the accessory plate 150 to only rotate a to predetermined" and insert --allows the accessory plate 150 to only rotate a predetermined--.

Signed and Sealed this
Thirtieth Day of July, 2013

Teresa Stanek Rea
*Acting Director of the United States Patent and Trademark Office*